US008387952B2

(12) United States Patent
Khan

(10) Patent No.: US 8,387,952 B2
(45) Date of Patent: Mar. 5, 2013

(54) STAPLE REMOVER

(76) Inventor: Saheed Khan, Montreal (CA)

( * ) Notice: Subject to any disclaimer, the term of this patent is extended or adjusted under 35 U.S.C. 154(b) by 528 days.

(21) Appl. No.: 12/668,516

(22) PCT Filed: Jul. 8, 2008

(86) PCT No.: PCT/CA2008/001271

§ 371 (c)(1),
(2), (4) Date: Jan. 11, 2010

(87) PCT Pub. No.: WO2009/006740

PCT Pub. Date: Jan. 15, 2009

(65) Prior Publication Data

US 2010/0187487 A1 Jul. 29, 2010

(30) Foreign Application Priority Data

Jul. 9, 2007 (GB) ..... 0713232.7

(51) Int. Cl.
*B25C 11/00* (2006.01)
*E21B 19/00* (2006.01)

(52) U.S. Cl. ..... 254/28; 254/21; 254/30; 227/63

(58) Field of Classification Search ..... 254/28, 254/21, 30

See application file for complete search history.

(56) References Cited

U.S. PATENT DOCUMENTS

| | | | | |
|---|---|---|---|---|
| 2,400,988 | A | 5/1946 | Goessel | |
| 3,625,482 | A | 12/1971 | Viel | |
| 4,513,951 | A | 4/1985 | Rogers | |
| 5,524,866 | A * | 6/1996 | Taylor | 254/28 |
| 5,653,424 | A * | 8/1997 | Khan | 254/28 |
| 6,257,554 | B1 * | 7/2001 | McDonough | 254/28 |
| 6,513,788 | B1 | 2/2003 | Ashe | |
| 7,090,198 | B1 * | 8/2006 | Gurmu | 254/28 |
| 7,131,636 | B1 * | 11/2006 | Gurmu | 254/28 |
| 2005/0092974 | A1 | 5/2005 | Ness | |

FOREIGN PATENT DOCUMENTS

JP 2001322071 A 11/2001

* cited by examiner

*Primary Examiner* — Monica Carter
*Assistant Examiner* — Nirvana Deonauth

(57) ABSTRACT

A staple remover, with a staple removing blade, for removing a staple from a stack of sheets of paper. The staple remover prevents staple jams by providing a means for automatically discarding removed staples from the staple removing blade. The staple remover comprises a storage compartment and an elongate staple removing blade. The elongate staple removing blade comprises a longitudinally extending staple pulling surface and a laterally flared portion located at the apex of the staple pulling surface. The geometry of the elongate staple removing blade substantially resiliently deforms the legs of the staple, allowing the legs to spring back towards each other and project the staple into the storage compartment.

18 Claims, 6 Drawing Sheets

Fig. 8
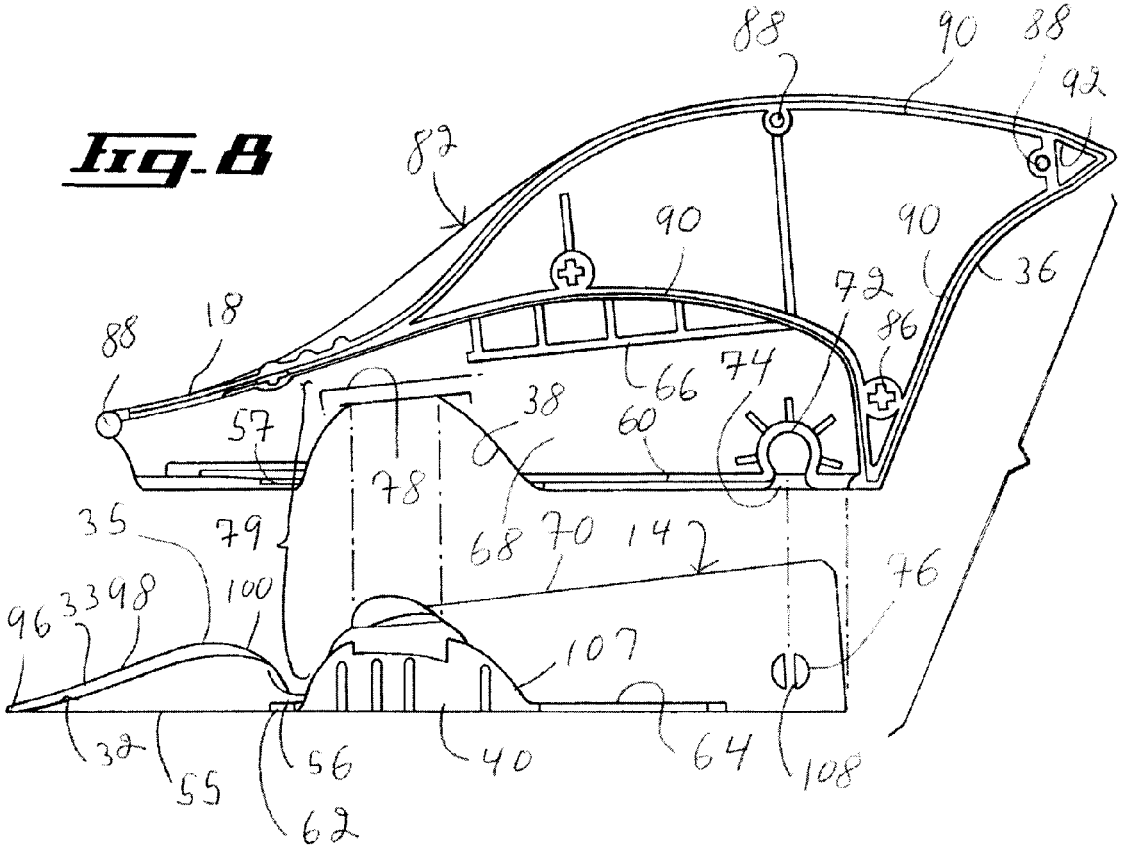
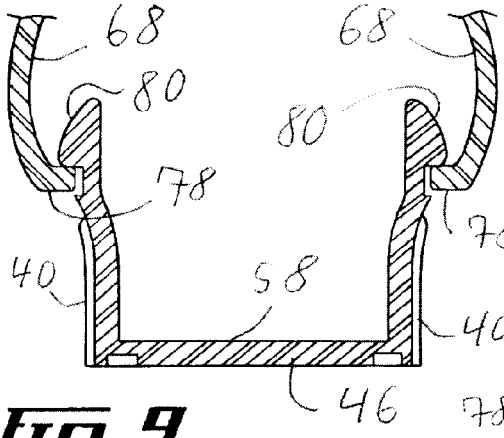
Fig. 9
Fig. 10
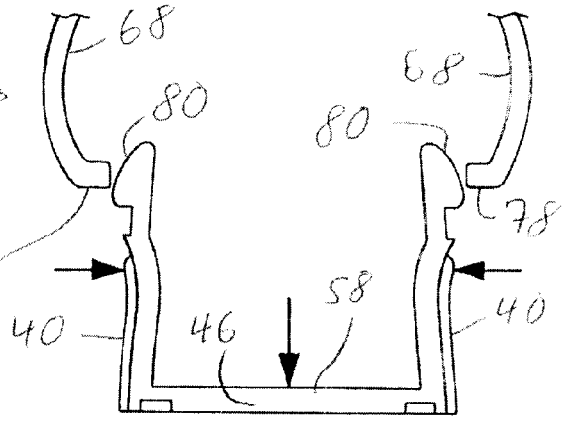

STAPLE REMOVER

FIELD OF THE INVENTION

The present invention relates generally to staple removers and, more particularly, to a staple remover comprising a leading staple removing blade and a storage compartment for retaining the used staples.

BACKGROUND

Staple removers are known in the art and are devices generally used for removing staples from a stack of sheets of paper stapled together. Two main types of staple removers can be found in the prior art. A first one, known as the jaw type staple remover, consists of a pair of hinged opposing jaws usable for grasping and removing a staple. The other type, known as the blade type staple remover, generally consists of a handle with a pointed, sharp tip blade protruding from one end. In this case, the pointed blade is inserted and forwarded under the crown of a staple to be removed until the latter is fully pulled out from the pile of paper sheets. Furthermore, the handle is generally hollow and acts as a storage compartment for retaining the used staples.

Typical examples of the prior art are U.S. Pat. No. 5,653,424, to Khan (Aug. 5, 1997), U.S. Pat. No. 4,513,951, to Rogers (Apr. 30, 1985), U.S. Pat. No. 3,625,482, to Veil (Dec. 7, 1971) and U.S. Pat. No. 6,513,788B1, to Ashe (Feb. 4, 2003).

While these staple removers of the prior art can generally fulfill the main objective of removing staples from a stack of sheets of paper, or the like, they also offer one or more of the following disadvantages:

a) they generally include an elongated staple removing blade that also serves as a storage ramp for the used staples. The used staples cumulating on the ramp can have their clenched legs entangled together and literally jam the rearward tossing of the staples on the ramp;

b) the cumulated staples on the storage ramp generally have to be removed from the ramp by hand since the staple legs generally preserve their tendency to spring back to their clenched configuration and, thus, are prone to stay clenched to the ramp;

c) they generally have an elongated and narrow handle-casing offering only limited stability and, thus, rendering the device difficult to manipulate during a staple removal operation;

Against this background, there exist a need for a new and improved staple remover that avoids the aforementioned disadvantages. It is a general object of the present invention to provide a new and improved staple remover.

SUMMARY OF THE INVENTION

In a broad aspect, the invention provides a staple remover for removing a staple from a stack of sheets of paper, the staple defining a crown and two legs each extending from the crown, the staple remover comprising:

a storage compartment; and a substantially elongated staple removing blade mechanically coupled to the storage compartment;

the staple removing blade defining a substantially flat and substantially longitudinally extending blade bottom end and a substantially opposed substantially longitudinally extending staple pulling surface;

the staple removing blade defining a front end portion and a substantially longitudinally opposed rear end portion, the rear end portion being located inside the storage compartment and the front end portion being located outside of the storage compartment, the blade bottom end and the staple pulling surface diverging from each other over at least a portion of the staple removing blade extending from the front end portion towards the rear end portion, the staple pulling surface defining an apex at a location where the staple pulling surface is maximally distanced from the blade bottom end;

the staple removing blade also defining a laterally flared portion substantially in register with the apex;

whereby, when the staple removing blade is inserted between the crown and the stack of sheets of paper and moved along the stack of sheets of paper so as to pull the staple from the stack of sheets of paper, the laterally flared portion substantially resiliently deforms the two legs before allowing the two legs to spring back towards each other and projecting the staple into the storage compartment when the staple has been pulled out of the stack of sheets of paper.

In another broad aspect, the laterally flared portion is not necessarily substantially adjacent to the apex.

According to an embodiment of the present invention, the staple remover generally comprises two main components, namely a handle-casing pivotally connected to a base component. The handle-casing is represented by a substantially hollow shell structure having a slightly slanted main body that ergonomically conforms to the grip of a hand, and equipped with depending splayed side walls that generally define the peripheral bottom edges of the device. The base component is typically made of a single-piece element manufactured out of a polymeric resin, or the like, using a conventional molding process. The base component generally comprises the staple removing blade integrally formed to the front end center portion of a used staples storage compartment. Pivot support means pivotally connect the handle-casing and the base component through a transversal axis substantially adjacent the rear end of the device. Cooperative pressing point interlocking means are provided between the handle-casing and the base component to allow a user to manually unlock and open the clam-shell like openable structure. Furthermore, the handle-casing is substantially overlapping the whole of the base component when the staple remover is in a closed configuration, except for a relatively small tip portion of the staple removing blade that is protruding through a horizontal opening at the front end of the handle-casing.

The staple removing blade has a relatively thin and substantially rounded-corner rectangular shape, with a soft curvilinear longitudinal cross-section starting with an acute front end substantially in coplanar relation with the underside of the staple remover, and is softly sinusoidally rising to a substantially rounded apex and typically relatively sharply dropping at the rear end limit of the blade. The highest portion of the blade roughly coincides with the rounded rear end portion of the latter, a region of the blade where, during a staple removal operation, the legs of a staple are fully pulled out of the stack of sheets of paper while, at the same time, the staple is self propulsed rearwardly into the storage compartment of the device due to the tendency of the staple legs to spring back to their clenched configuration against the rounded rear end portion of the blade.

The staple remover is used in the same conventional manner as with other blade type staple removers of the prior art, which consists in firmly grabbing the staple remover with one hand and lay down the bottom end of the latter flat against a stack of stapled sheets of paper. The user can then insert the tip of the pointed blade under the crown of a staple to be removed and force the staple remover forward in a continuous motion until the elevated rear end portion of the blade pulls the staple out of the top surface of the paper, while at the same time, causes the staple to be self-propulsed into the storage compartment of the device. The cumulated used staples can then be safely dumped into a refuse receptacle by simply pressing on the lateral pressing points of the base component with one hand and opening the pivotable handle-casing with the other hand while the blade is substantially pointing downward towards the refuse receptacle.

The main advantages of the present invention is a staple remover:

a) which has a relatively efficient staple removing blade design allowing a user to efficiently remove staples from a stack of sheets of paper or other materials;

b) whose ergonomic handle-casing design offers a relatively firm grip and a stable support to the user during a staple removal operation;

c) whose content of used staples is relatively easily and conveniently emptied through its openable front end and can, hence, be dumped directly into a refuse receptacle;

d) which is relatively simple and inexpensive in construction, and yet which is relatively efficient and reliable in operation.

Other objects, advantages and features of the present invention will become more apparent upon reading of the following non-restrictive description of preferred embodiments thereof, given by way of example only with reference to the accompanying drawings.

BRIEF DESCRIPTION OF THE DRAWINGS

FIG. 8: is a side elevational exploded view, showing a longitudinal half section of the handle-casing, and a side elevational view of the base component;

FIG. 9: is a fragmented lateral cross-sectional view of the staple remover, taken along lines IX-IX in FIG. 4, and showing the lateral locking means of the handle-casing in a closed position on the base component;

FIG. 10: is a fragmented lateral cross-sectional view of the staple remover shown in FIG. 9, showing the pressure points on the lateral locking means of the base component, thus allowing the handle-casing to pivotally open;

DETAILED DESCRIPTION

Figure 1:
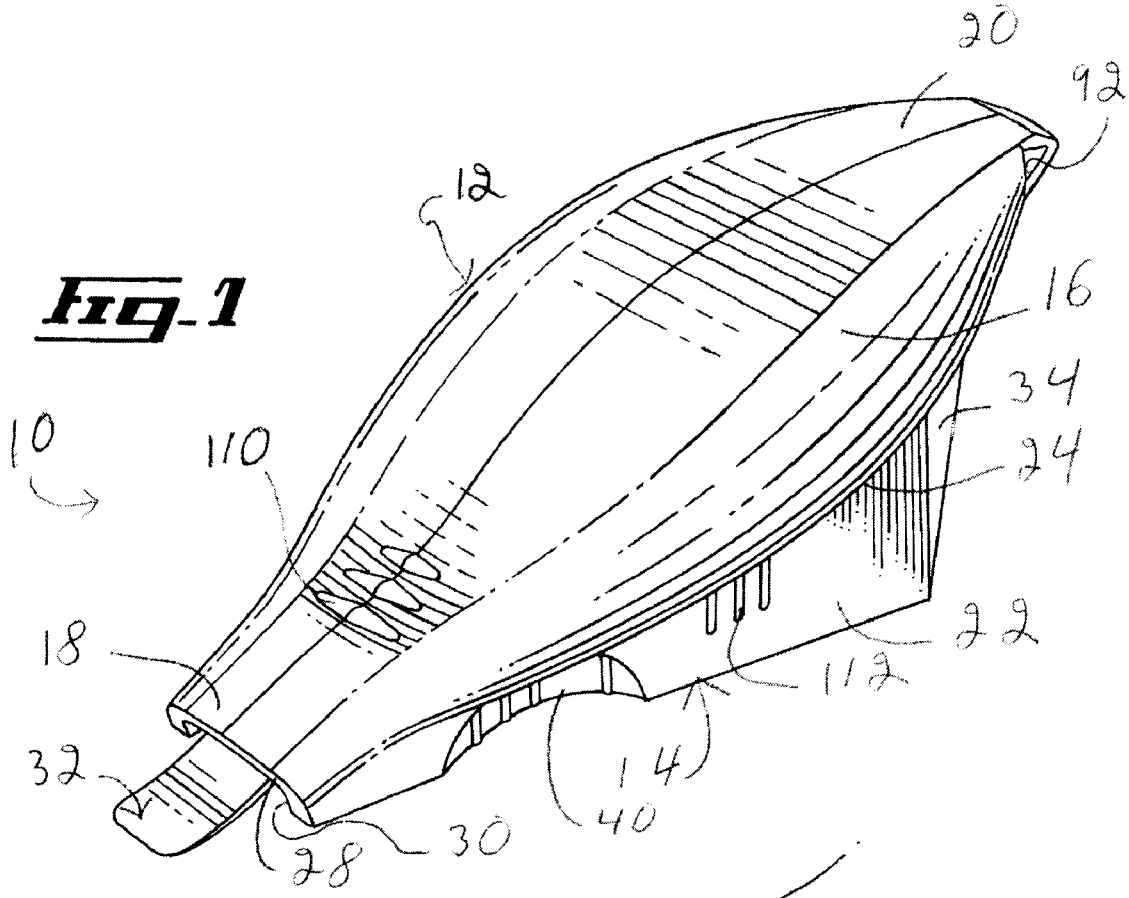
FIG. 1: is a top perspective view of a staple remover according to an embodiment of the present invention.
Figure 6:
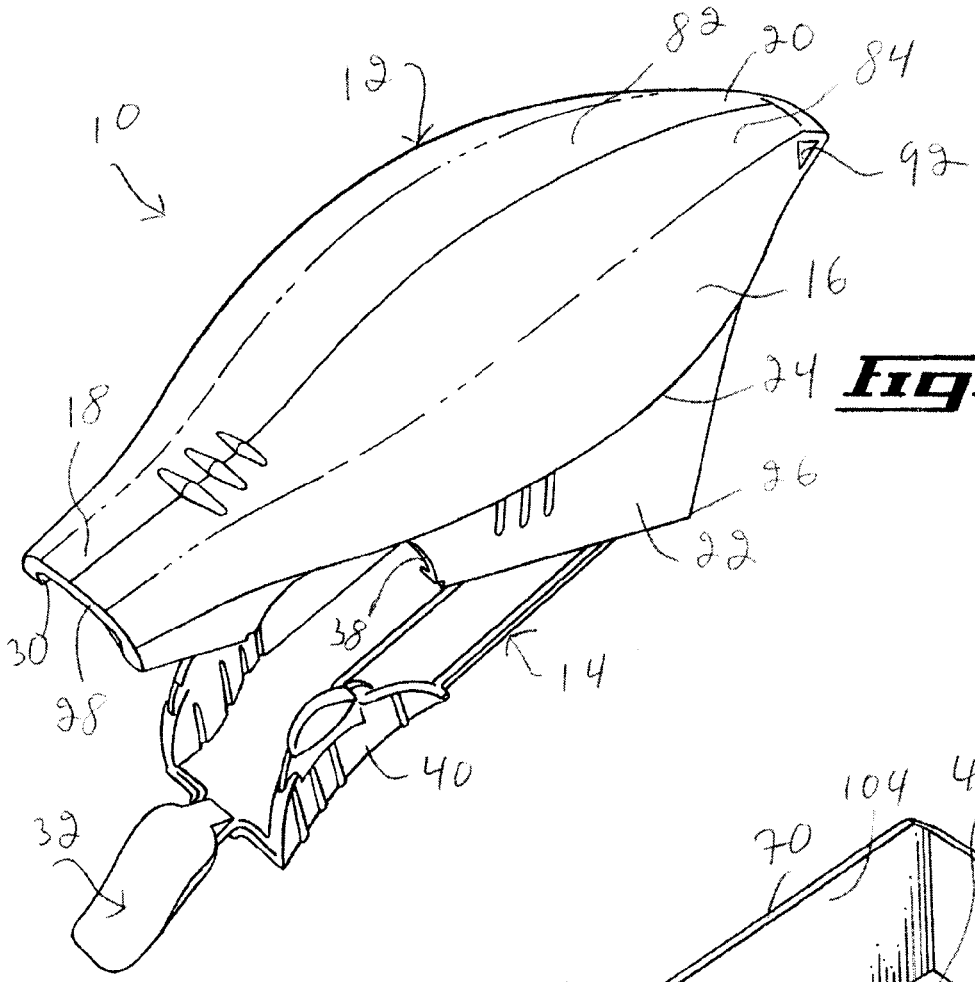
FIG. 6: is a top perspective view of the staple remover shown in FIG. 1, showing a handle-casing thereof in an open position.
Figure 7:
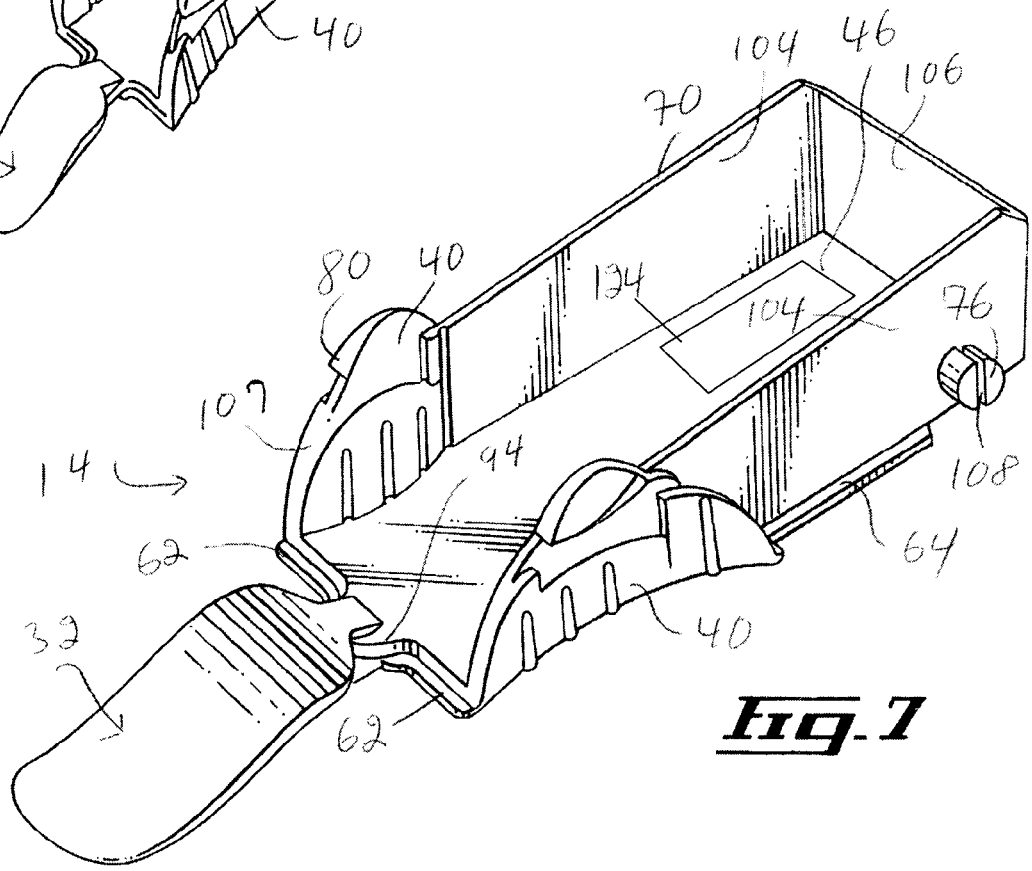
FIG. 7: is a top perspective view of a base component of the staple remover shown in FIG. 1.

FIGS. 1, 6 and 7 best show various aspects of a staple remover 10 in accordance with an embodiment of the present invention. The staple remover 10 generally comprises a substantially hollow handle-casing 12 pivotally attached to a base component 14.

Referring now to FIGS. 6 and 8, the upper portion of handle-casing 12 is generally defined by a slightly inclined and substantially elongated ellipsoidal central body 16 terminated with substantially longitudinally tapering and horizontally flattened front and rear end sections 18 and 20 respectively. The front and rear end sections 18 and 20 each extend substantially longitudinally substantially opposed to each other from the central body 16.

Handle-casing 12 further comprises integrally formed and correspondingly-shaped lower side walls 22 extending downwardly from oppositely corresponding underlying longitudinal side edges 24 of the ellipsoidal central body 16, and extending from the lateral sides of the tapering front end section 18 to roughly two-thirds of the total length of handle-casing 12. Furthermore, lower side walls 22 have a gradually laterally splayed configuration starting from each sides of the flattened front end 18, and progressively outwardly toward their bottom rear end portion 26.

Figure 5:
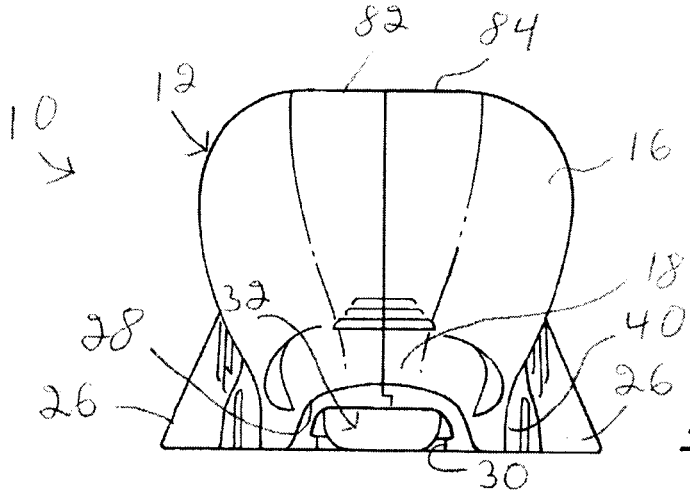
FIG. 5: is a front elevational view of the staple remover shown in FIG. 1.

The front ends of lower side walls 22 are defining, along with the tapered front end section 18, an inverted U-shaped front end 28, as best illustrated in FIGS. 5 and 6. It is to be noted that the inverted U-shaped front end 28 is configured and sized such that a correspondingly inner U-shaped gap 30 is defined between the inner edge of U-shaped front end 28 and staple removing blade 32 of base component 14, which will be described in more details hereinafter.

Figure 2:
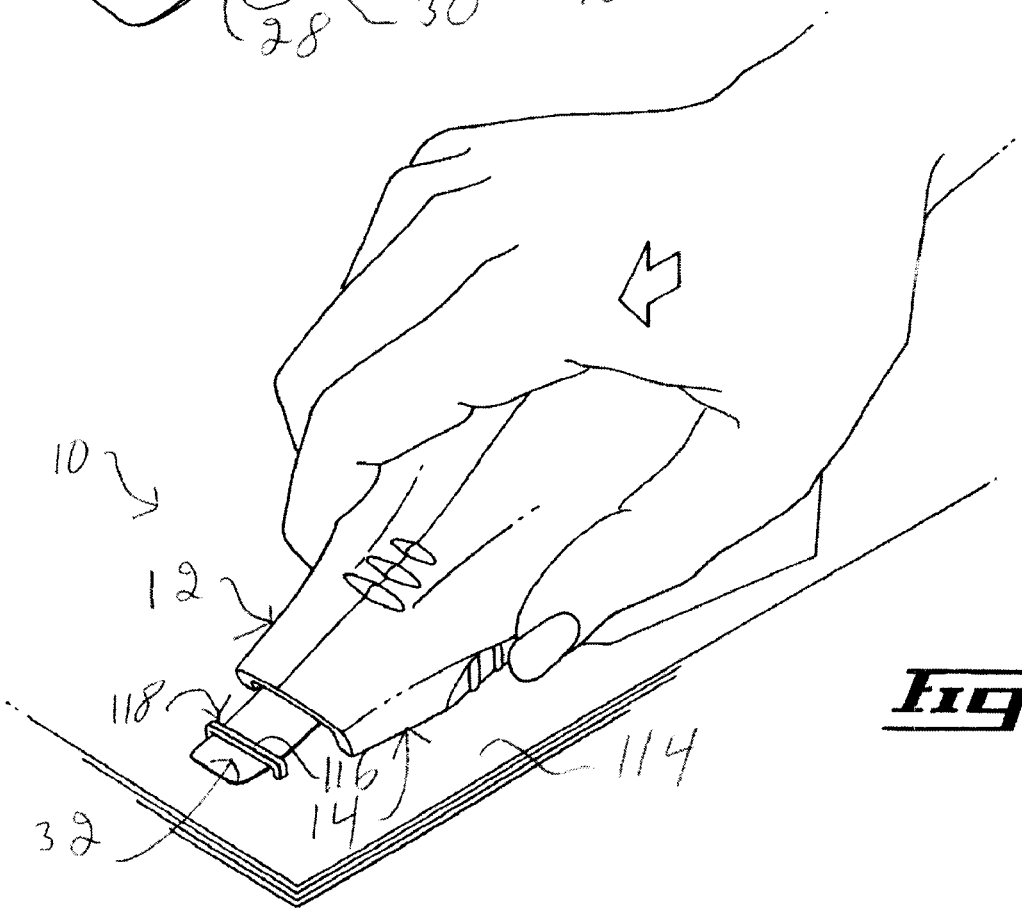
FIG. 2: is an environmental top perspective view of the staple remover shown in FIG. 1, illustrating the gripping position and movement of the hand of a user during a staple removal operation on a stack of stapled sheets of paper.
Figure 3:
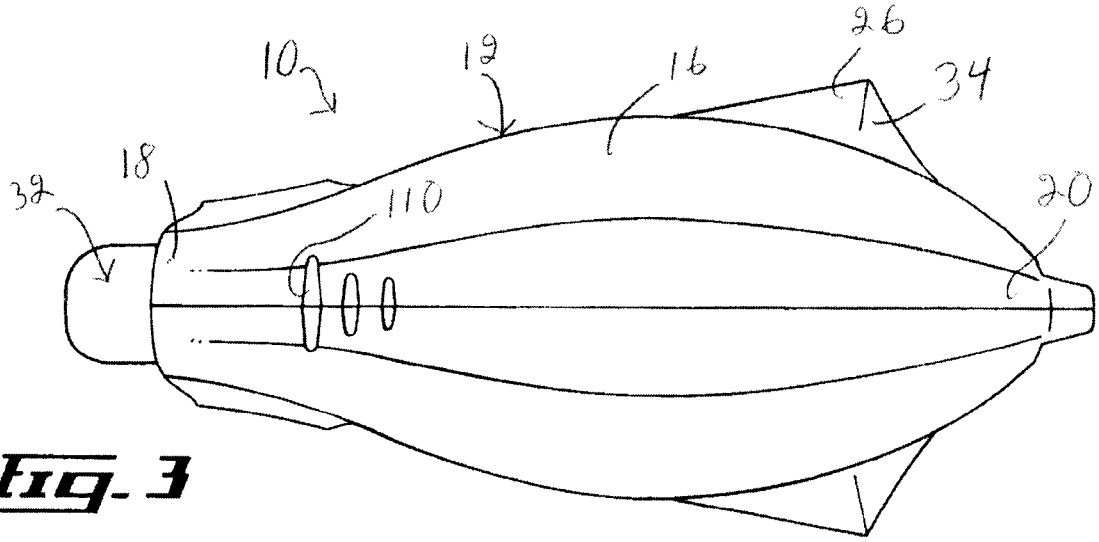
FIG. 3: is a top plan view of the staple remover shown in FIG. 1.
Figure 4:
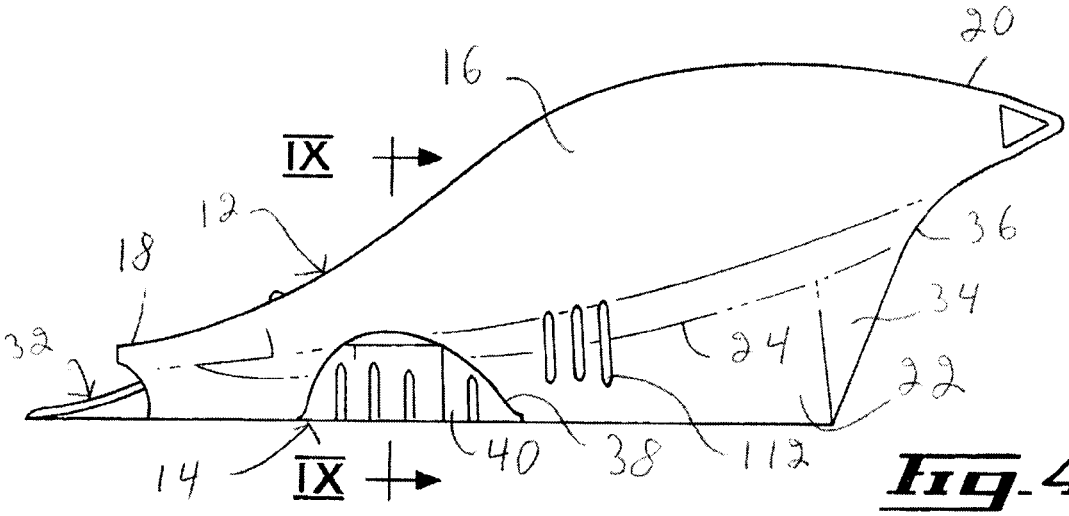
FIG. 4: is a side elevational view of the staple remover shown in FIG. 1.
Figure 11:
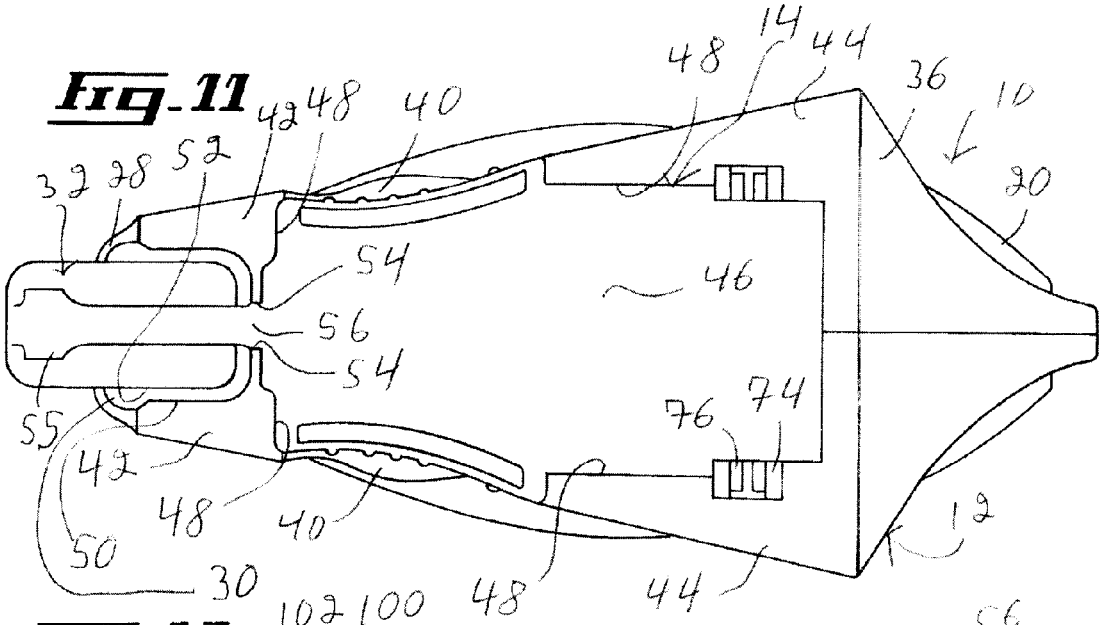
FIG. 11: is a bottom plan view of the staple remover in FIG. 1.

The lower side walls 22 are extended at their rearward end by inwardly tapering intermediate end walls 34 and an inwardly arcuate rear wall 36 extending from the bottom end of the staple remover 10 to the tapered rear end section 20 of handle-casing 12 (as best illustrated in FIGS. 4 and 11). Thus, handle-casing 12 is preferably shaped and sized to ergonomically conforms to the hand grip of a user (as best shown in FIG. 2), with the outwardly splayed lower side walls 22 providing stability to the assembled staple remover 10 during use. It is to be understood that the central body 16 and lower side walls 22 of the handle-casing 12 described heretofore may have any other comparable ergonomically shaped and operatively stable configuration.

As seen for example in FIG. 4, correspondingly-shaped half-disk recesses 38 are oppositely provided along the lower front half portion of lower side walls 22. The half-disk recesses 38 are in register with corresponding and oppositely disposed half disk-shaped lateral pressing points 40 provided on each sides of base component 14, which will be described in more details hereinafter.

As best illustrated in FIG. 11, handle-casing 12 has a partial bottom wall represented by coplanar front and rear wall segments 42 and 44 respectively. The generally centered space between the wall segments is occupied by a bottom wall 46 of the base component 14. The inner edges 48 of the coplanar wall segments 42, 44 are in register with the adjacent outer peripheral edges of bottom wall 46. The walls segments 42 allows to hold the stack of stapled sheets of paper 114 (shown in FIG. 2) flat to help the staple removing blade 32 removing the staple evenly.

Frontward bottom wall segments 42 further provide indentations 50 that are substantially defining a correspondingly circumscribing space gap 52 around the outer rear half portion of the overlaying staple removing blade 32, except for a central opening 54 which is in register with an elongated longitudinal support member 56 linking the staple removing blade 32 to a storage compartment 58 of the base component 14.

Furthermore, provided along the inner edges 48 of coplanar bottom wall segments 42 and 44 there are front and rear abutment lips 57 and 60 respectively (as best seen in FIG. 8) that are in register with correspondingly shaped abutment lips 62 and 64 provided along the lateral and front peripheral lower edges of the storage compartment 58 (as best shown in FIGS. 7 and 8). Additional support is provided through oppositely disposed upper abutment lips 66 on the inner side walls 68 of handle-casing 12 for correspondingly abutting against the upper edges 70 of storage compartment 58. Hence, abutment lips 57 and 60 of handle-casing 12 are providing a reinforced abutment limit of the latter against the abutment lips 62, 64 and upper edges 70 of base component 14, in cooperative relation with the inter-locking mechanism between the half-disk recesses 38 of handle-casing 12, and the disk-shaped lateral pressing points 40 on each sides of base component 14, which will be described in more details below. When handle-casing 12 is pivotally closed over base component 14, with all the corresponding abutment lips 57, 60, 62 and 64 described above, pressed against one another, the bottom wall segments are in a substantially coplanar relationship with bottom wall 46 of the storage compartment 58, the bottom surface of the elongated longitudinal support member 56 and the blade bottom end 55 of the staple removing blade 32.

As shown in FIG. 8, inner side walls 68 of handle-casing 12 are provided with oppositely disposed and substantially C-shaped, transverse pivot support means 72 having a pivot insertion opening 74 accessible through the inner edge 48 of the coplanar rear bottom wall segments 44 (as best illustrated in FIG. 11). Pivot support means 72 are for pivotally receiving, in a resilient snap-fit connection, the corresponding lateral pivot studs 76 provided on each sides of base component 14.

The inner side walls 68 of handle-casing 12 are further provided with inwardly protruding locking lips 78 integrally formed adjacently above the half-disk shaped recesses 38. Locking lips 78 are for receiving, in a resilient snap-fit relation, the locking prongs 80 positioned above the corresponding half-disk shaped pressing points 40 of base component 14, which will be described in more details below.

Referring to FIG. 5, as with conventional mass products of comparable size that are typically composed of an assembly of molded plastic elements, handle-casing 12 is preferably formed of two relatively symmetrical longitudinal halves sections 82 and 84 manufactured out of a polymeric resin or a light metal alloy using a conventional injection molding process.

For keeping the opposite halves sections 82 and 84 assembled together, conventional coupling means commonly found in comparable prior art assemblies are represented here by a plurality of transversal assembling pins 86 and 88 having substantially "X" shaped cross-sections and round cross-sections respectively, as best illustrated in FIG. 8. Assembling pins 86 and 88 are integrally formed and protruding perpendicularly from the inner surface of the inner side walls 68 of one of the halves sections, with corresponding assembling pins receiving channels (not shown) integrally formed and protruding perpendicularly from the inner surface of the opposite half section. The assembling pins receiving channels are configured and sized as to fittingly receive respectively, in a press-fit relation, the assembling pins 86, 88 when the halves sections 82 and 84 are assembled together.

The assembling pins 86, 88 and corresponding assembling pins receiving channels are suitably distributed within the halves sections 82, 84 inner surface walls so as to render proper alignment and structural strength to the assembled halves sections. To further assure a robust structural integrity to the assembled handle-casing 12, an arrangement of correspondingly overlapping edge lips 90 around the adjoining edges of both halves section 82, 84 are provided so that handle-casing 12 can withstand the rigors of handling, as well as to render a firm homogeneous surface along the adjoining edges of the halves sections.

It is to be understood that other types of coupling means such as, for example, glue, screws, or an integrally molded arrangement of prongs and corresponding locking notches adapted to be snap-fit into a locked engagement, may be used to rigidly fix the pair of opposite halves sections 82, 84 together.

A convenient attachment positioned at or near the tapered rear end section 20, such as a through-hole 92 (as best illustrated in FIGS. 1 and 4), a hook, or the like, may be provided for attaching the staple remover 10, for example, to a wristband or to a single rope which, in turn, is attached nearby a dedicated station such as a photocopier.

FIG. 7 shows base component 14 generally comprising a lightly undulated staple removing blade 32 integrally formed to the front-center portion 94 of the storage compartment 58 through the longitudinal support member 56 that mechanically couples the storage compartment 58 and the staple removing blade 3 to each other.

Figure 13:
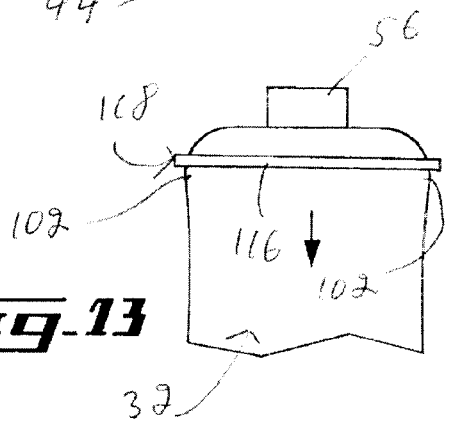
FIG. 13: is a fragmented top plan view of the rear end portion of the staple removing blade shown in FIG. 12, and illustrating an extracted staple nearing the rear end limit of the blade, prior to being expulsed into the storage compartment of the staple remover.

As illustrated more specifically in FIGS. 8 and 11, in which can be seen respectively a side elevational view and a bottom plan view of the staple removing blade 32, the latter is substantially elongated and has a relatively thin and substantially rounded-corner rectangular shape, with a longitudinal cross-section defining a substantially soft curvilinear slope beginning with a substantially acute front end portion 96, followed by a softly rising curvilinear mid-portion slope 98 and a relatively rounded rear end portion 100. Integrally formed elongated support member 56 is longitudinally and centrally extending under the staple removing blade 32 to link the latter, in a coplanar relation, with the front-center portion 94 of storage compartment 58. Furthermore, as can be seen in FIG. 13, which shows a fragmented top plan view of the rear end portion 100 of the staple removing blade 32, there is a lightly laterally flared portion 102 near the rear end limit of the latter, whose purpose will be explained in the text below detailing the operative use of the staple remover 10.

The staple removing blade 32 defines a substantially flat and substantially longitudinally extending blade bottom end 55 and a substantially opposed substantially longitudinally extending staple pulling surface 33. The blade bottom end 55 and the staple pulling surface 33 diverge from each other over at least a portion of the staple removing blade 32 extending from the front end portion 96 towards the rear end portion 100. The staple pulling surface defines an apex 35 at a location where the staple pulling surface 33 is maximally distanced from the blade bottom end 55. The laterally flared portion 102 is substantially in register with the apex 35.

Typically, the rear end portion 100 is located inside the storage compartment 58 and the front end portion 96 is located outside of the storage compartment 58. Typically, the front end section 18 projects forwardly past the laterally flared portion 102.

It has been found that having a staple removing blade 32 having a length that is from about 2 to about 4 times a distance between the blade bottom end 55 and the apex 35 provides a staple remover 10 that is relatively efficient in removing staples 118 and provides a good compromise between minimizing frictional forces between the staple 118 and the staple removing blade 32 and facilitating ergonomic movements of the staple remover 10.

Figure 16:
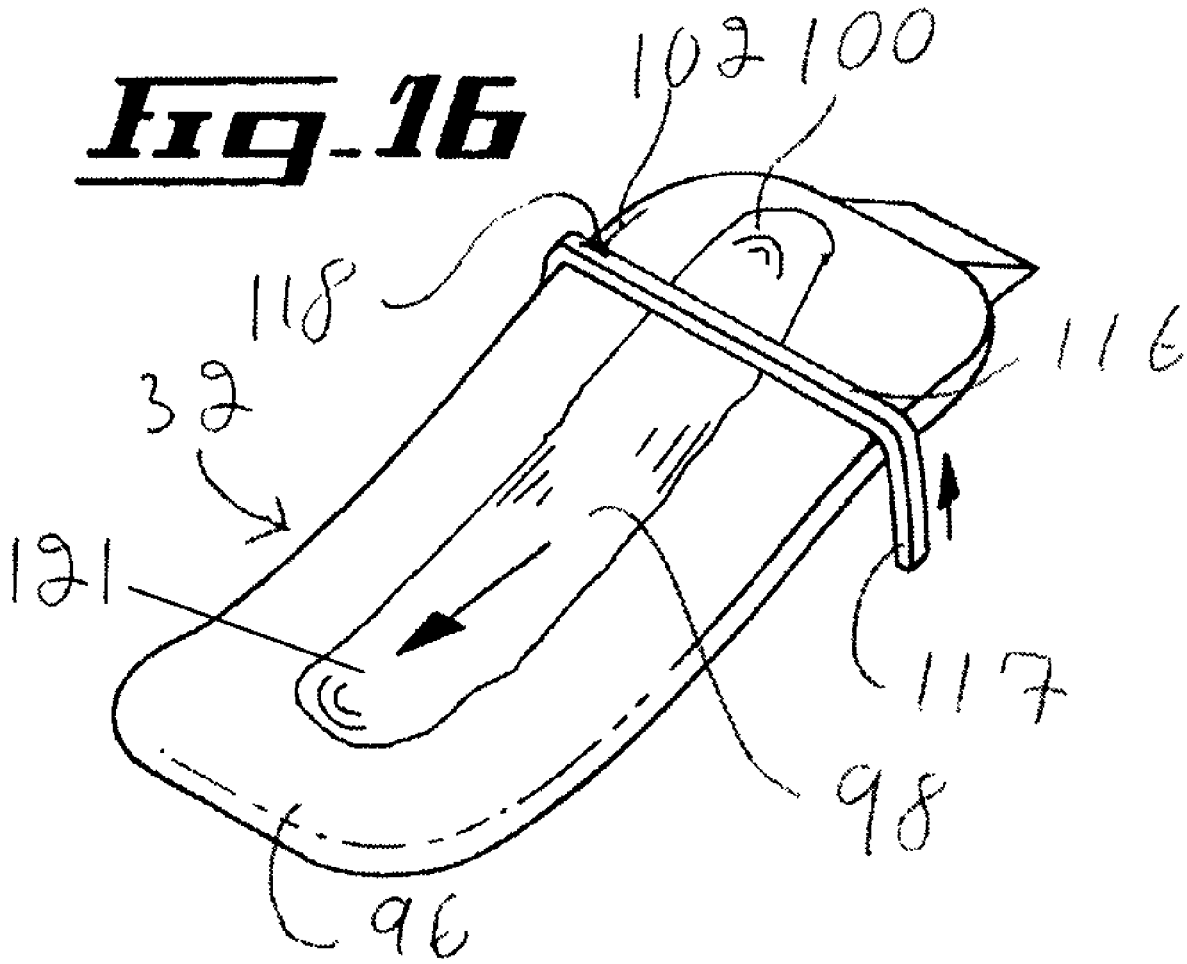
FIG. 16: is a top perspective view of a staple removing blade in accordance with an alternative embodiment of the invention.

As seen in FIG. 16, in some embodiments of the invention, the staple removing blade 32 defines a groove 121 extending into the staple pulling surface 33, the groove 121 extending substantially longitudinally. The groove 121 reduces frictional forces between the staple removing blade 32 and the staple 118.

As seen in FIG. 11, the blade bottom end 55 is substantially laterally narrower substantially adjacent the apex 35 (not seen in FIG. 11) than substantially adjacent the front end portion 96. The narrow configuration near the apex 35 reduces friction between the legs 117 of the staple 118 and the staple removing blade 32 when the staple 118 is pulled out and slid along the staple removing blade 32. The wider configuration adjacent to the front end portion 96 provides rigidity to the staple removing blade 32 when the staple removing blade 32 starts pulling out the staple 118, which typically requires a relatively large force.

Referring now to FIG. 7, the used staple storage compartment 58 is generally defined by an open-ended three-sided container having opposed side walls 104, a rear wall 106 and a bottom wall 46. A pair of oppositely disposed inwardly concave and substantially half-disk shaped pressing points 40 are integrally formed in the front end portion of side walls 104. The outwardly protruding, rounded peripheral edges 107 circumscribing the pressing points 40 are in register with the inner peripheral edge of the half-disk shaped recesses 38 provided in the lower side walls 22 of handle-casing 12 described above. Locking prongs 80 are protruding upwardly and laterally outwardly from the top portion of the half-disk shaped pressing points 40, and are configured and sized so as to be adapted to lockingly abut against the upper edge of the inwardly protruding locking lips 78 integrally formed adjacently above the half-disk shaped recesses 38, on the inner side walls 68 of handle-casing 12, as shown in FIG. 9.

Therefore, the locking lips 78 and locking prongs 80 form a lock 79 for locking the handle-casing 12 and the base component 14 to each other for selectively preventing pivotal movement of the handle-casing 12 and base component 14 relative to each other. The lock 79 therefore includes cooperative pressing point interlocking elements provided between the handle-casing 12 and the base component 14 to allow selective unlocking of the handle-casing 12 and the base component 14 from each other for allowing pivotal movement therebetween.

A pair of pivot studs 76 are perpendicularly and oppositely extending outwardly from the outer surface of side walls 104 near the lower rear end portion of the storage compartment 58. Pivot studs 76 are further provided with a vertical slot 108 for ease of insertion, in a resilient snap-fit connection, through the pivot insertion opening 74 of the C-shaped pivot support means 72 provided on the inner side walls of handle-casing 12.

It is to be noted that other pivot means may as well be used instead of the pivot studs 76 and C-shaped pivot support means 72 configuration described above such as, for example, a pair of punched rivets or a single transversal pivot pin.

As best illustrated in FIG. 8, the upper portion of side walls 104 and rear end wall 106 of the storage compartment 58 are appropriately configured and sized to allow a free pivotal movement of handle-casing 12 relative to base component 14 in an assembled staple remover 10.

Base component 14 is preferably made of a single-piece element and, likewise the halves sections 82, 84 of handle-casing 12 described above, may be manufactured out of a polymeric resin or a light metal alloy using a conventional injection molding process, or be manufactured from a sheet of metal using a progressive or multi-stage punch-press process.

Whether base component 14 is manufactured using an injection molding process or a punch press process, the resulting design and thickness of the base component, particularly at or near the junction between the concave pressing points 40 and the side and bottom walls 104 and 46 of the storage compartment 58 must be appropriately configured and sized to allow sufficient inward resilient movement of the pressing points 40 as to allow a user to inwardly press on the latters between the index and thumb without having to use excessive force and, hence, be able to pivotally open handle-casing 12 relative to the base component 14 (as best demonstrated through FIGS. 6, 9 and 10).

Furthermore, as seen in FIG. 1, there are horizontal and vertical elongated protrusion 110 and 112 respectively that are appropriately disposed on the top and sides of the staple remover 10 to enhance the grip of a hand around the latter during a staple removal operation. It is to be understood that other means to enhance the hand grip may be used such as, for example, textured gel pads or the like.

Figure 12:
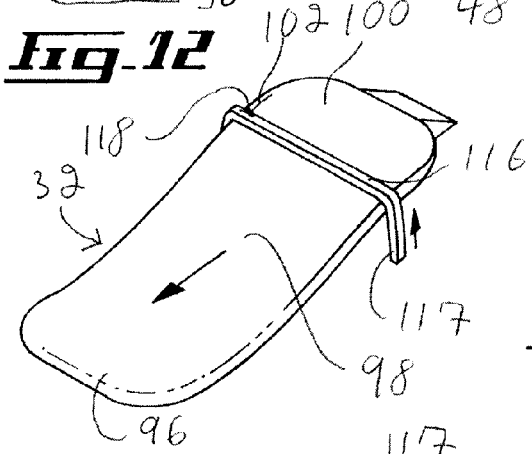
FIG. 12: is a top perspective view of the staple removing blade of the staple remover shown in FIG. 1 showing the extraction operation of a staple.
Figure 14:
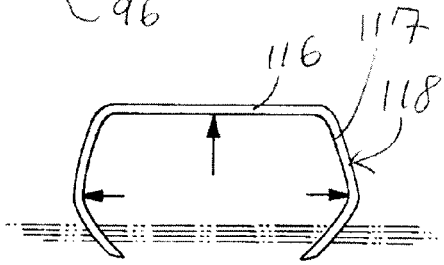
FIG. 14: shows the expanding mechanical forces applied on a staple being extracted from a pile of paper sheets by the staple removing blade in FIG. 12.
Figure 15:
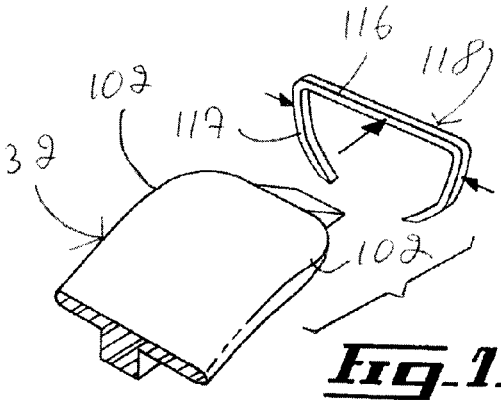
FIG. 15: is a fragmented top perspective view of the rear end portion of the staple removing blade in FIG. 12, showing the self contracting forces applied on an extracted staple while being expulsed from the rear end limit of the blade.

In operative use, a user grips the staple remover 10 mainly by the central body 16 of the handle-casing 12, as shown in FIG. 2, and lay down the bottom end of the latter flat against a pile of stapled sheets 114, with the front end portion 96 of the staple removing blade 32 abutting against the protruding crown 116 of a staple 118 secured through the papers with legs 117 extending from the crown 116. As the staple remover 10 is moved horizontally forwardly, the staple removing blade 32 is gradually inserted under the crown 116 until the underlying clenched legs 117 of the staple 118 are progressively stretched up and lightly expanded laterally due to, respectively, the softly rising curvilinear mid-portion slope 98 and the laterally flared portion 102 of the staple removing blade 32, as illustrated sequentially through FIGS. 12, 13 and 14. Depending on the leg length of the staple 118, the latter may be fully pulled out of the pile of paper sheets 114 as it reaches the flared rear end portion 102 of the blade, at which point the staple 118 may be self propulsed rearwardly into the used staple storage compartment 58 due to the tendency of the staple legs 117 to spring back to their clenched configuration (as illustrated in FIG. 15). It is to be noted that the front end section 18 of handle-casing 12 projects forwardly past the flared rear end portion 102 of the staple removing blade 32 to assure that the propulsed staple is constrained within the staple remover 10. Alternately, such as when the staple 118 has longer legs and is still partly clenched to the pile of paper sheets 114 once it is passed the flared rear end portion 102 of the blade, the continued forward movement of the staple remover 10 eventually forces the partly removed staple 118 against the front-center portion 94 of the storage compartment 58 where it is forcibly pulled out above the top surface of the paper 114. Finally, by slightly tilting upwardly the front end of the staple remover 10, the removed staples are thus safely tossed to the rear end of the storage compartment. The cumulated used staples may then be discarded by pressing on the lateral pressing points 40 with one hand and pivotally open the handle-casing 12 with the other hand to dump the content of the staple remover 10 into a refuse receptacle (not shown in the drawings).

In some alternate embodiments, a thin sheet magnet 124 (seen in FIG. 7) may be mounted inside the storage compartment 58 for magnetically retaining the used staples 118 being cumulated therein. For example, the magnet 124 is attached to the base component 14.

Although the present invention has been described hereinabove by way of preferred embodiments thereof, it can be modified, without departing from the spirit and nature of the subject invention as defined in the appended claims.

What is claimed is:

1. A staple remover for removing a staple from a stack of sheets of paper, said staple defining a crown and two legs each extending from said crown, said staple remover comprising:

a storage compartment, and a substantially elongated staple removing blade mechanically coupled to said storage compartment;

said staple removing blade defining a substantially flat and substantially longitudinally extending blade bottom end and a substantially opposed substantially longitudinally extending staple pulling surface;

said staple removing blade defining a front end portion and a substantially longitudinally opposed rear end portion, said rear end portion being located inside said storage compartment and said front end portion being located outside of said storage compartment, said blade bottom end and said staple pulling surface diverging from each other over at least a portion of said staple removing blade extending from said front end portion towards said rear end portion, said staple pulling surface defining an apex at a location where said staple pulling surface is maximally distanced from said blade bottom end;

said staple removing blade also defining a laterally flared portion substantially in register with said apex, at least part of said staple pulling surface being defined by said laterally flared portion;

wherein, when said staple removing blade is inserted between said crown and said stack of sheets of paper and moved along said stack of sheets of paper so as to pull said staple from said stack of sheets of paper, said laterally flared portion substantially resiliently deforms said two legs before allowing said two legs to spring back towards each other and projecting said staple into said storage compartment when said staple has been pulled out of said stack of sheets of paper.

2. A staple remover as defined in claim 1, wherein said staple removing blade defines a groove extending into said staple pulling surface, said groove extending substantially longitudinally.

3. A staple remover as defined in claim 1, wherein said blade bottom end is substantially laterally narrower substantially in register with said apex than a portion thereof substantially adjacent said front end portion.

4. A staple remover as defined in claim 1, wherein said storage compartment is defined by a base component pivotally attached to a handle-casing.

5. A staple remover as defined in claim 4, further comprising a magnet mounted in said storage compartment.

6. A staple remover as defined in claim 5, wherein said magnet is attached to said base component.

7. A staple remover as defined in claim 4, further comprising a lock for locking said handle-casing and said base component to each other for selectively preventing pivotal movement of said handle-casing and said base component relative to each other.

8. A staple remover as defined in claim 7, wherein said lock includes cooperative pressing point interlocking elements provided between said handle-casing and said base component to allow selective unlocking of said handle-casing and said base component from each other for allowing pivotal movement therebetween.

9. A staple remover as defined in claim 4, wherein said handle-casing includes a substantially elongated substantially ellipsoidal central body.

10. A staple remover as defined in claim 9, wherein said handle-casing includes substantially longitudinally tapering front and rear end sections each extending substantially longitudinally substantially opposed to each other from said central body.

11. A staple remover as defined in claim 10, wherein said front end section projects forwardly past said laterally flared portion.

12. A staple remover as defined in claim 1, wherein said staple removing blade has a longitudinal cross-section defining a substantially soft curvilinear slope.

13. A staple remover as defined in claim 12, wherein said substantially soft curvilinear slope defines a substantially acute front end portion, a substantially rounded rear end portion and a substantially softly rising curvilinear mid-portion slope.

14. A staple remover as defined in claim 1, wherein said apex is substantially adjacent said rear end portion.

15. A staple remover as defined in claim 1, said staple remover further comprising an attachment for attaching said staple remover to a rope.

16. A staple remover as defined in claim 1, wherein a longitudinal length of said staple removing blade is from about 2 to about 4 times a distance between said blade bottom end and said apex.

17. A staple remover for removing a staple from a stack of sheets of paper, said staple defining a crown and two legs each extending from said crown, said staple remover comprising:

a storage compartment; and a substantially elongated staple removing blade mechanically coupled to said storage compartment;

said staple removing blade defining a substantially planar and substantially longitudinally extending base and a substantially opposed substantially longitudinally extending staple pulling surface;

said staple removing blade defining a front end portion and a substantially longitudinally opposed rear end portion, said rear end portion being located inside said storage compartment and said front end portion being located outside of said storage compartment, said base and said staple pulling surface diverging from each other over at least a portion of said staple removing blade extending from said front end portion towards said rear end portion, said staple pulling surface defining an apex at a location where said staple pulling surface is maximally distanced from said base;

said staple removing blade also defining a laterally flared portion substantially adjacent said rear end portion, at least part of said staple pulling surface being defined by said laterally flared portion;

whereby, when said staple removing blade is inserted between said crown and said stack of sheets of paper and moved along said stack of sheets of paper so as to pull said staple from said stack of sheets of paper, said laterally flared portion substantially resiliently deforms said two legs before allowing said two legs to spring back towards each other and projecting said staple into said storage compartment when said staple has been pulled out of said stack of sheets of paper.

18. A staple remover for removing a staple from a stack of sheets of paper, said staple defining a crown and two legs each extending from said crown, said staple remover comprising:

a storage compartment defined by a base component pivotally attached to a handle-casing;

a substantially elongated staple removing blade mechanically coupled to said storage compartment;

said staple removing blade defining a substantially flat and substantially longitudinally extending blade bottom end and a substantially opposed substantially longitudinally extending staple pulling surface;

said staple removing blade defining a front end portion and a substantially longitudinally opposed rear end portion, said rear end portion being located inside said storage compartment and said front end portion being located outside of said storage compartment, said blade bottom end and said staple pulling surface diverging from each other over at least a portion of said staple removing blade extending from said front end portion towards said rear end portion, said staple pulling surface defining an apex at a location where said staple pulling surface is maximally distanced from said blade bottom end;

said staple removing blade also defining a laterally flared portion substantially in register with said apex, at least part of said staple pulling surface being defined by said laterally flared portion; and a lock for locking said handle-casing and said base component to each other for selectively preventing pivotal movement of said handle-casing and said base component relative to each other, said lock including cooperative pressing point interlocking elements provided between said handle-casing and said base component to allow selective unlocking of said handle-casing and said base component from each other for allowing pivotal movement therebetween;

whereby, when said staple removing blade is inserted between said crown and said stack of sheets of paper and moved along said stack of sheets of paper so as to pull said staple from said stack of sheets of paper, said laterally flared portion substantially resiliently deforms said two legs before allowing said two legs to spring back towards each other and projecting said staple into said storage compartment when said staple has been pulled out of said stack of sheets of paper.

* * * * *